US005988602A

United States Patent [19]

Yokoyama et al.

[11] Patent Number: 5,988,602

[45] Date of Patent: Nov. 23, 1999

[54] VARIABLE VENTURI CARBURETOR

[75] Inventors: Takashi Yokoyama; Takashi Udono, both of Saitama, Japan

[73] Assignee: Honda Giken Kogyo Kabushiki Kaisha, Tokyo, Japan

[21] Appl. No.: 08/992,531

[22] Filed: Dec. 17, 1997

[30] Foreign Application Priority Data

Dec. 17, 1996 [JP] Japan ..... 8-336955

[51] Int. Cl.[6] ..... F02M 9/06

[52] U.S. Cl. ..... 261/35; 261/44.4; 261/69.1; 261/DIG. 56; 261/DIG. 68

[58] Field of Search ..... 261/34.1, 35, 44.4, 261/69.1, DIG. 12, DIG. 38, DIG. 56, DIG. 68

[56] References Cited

U.S. PATENT DOCUMENTS

| | | | |
|---|---|---|---|
| 2,144,017 | 1/1939 | Gistucci | 261/DIG. 68 |
| 4,290,399 | 9/1981 | Takada et al. | 261/44.4 X |
| 4,300,490 | 11/1981 | Hattori et al. | 261/44.4 X |
| 4,477,392 | 10/1984 | Nakamura et al. | 261/44.4 X |
| 5,480,592 | 1/1996 | Morrow | 261/44.4 |
| 5,648,023 | 7/1997 | Nojima | 261/44.4 |
| 5,707,560 | 1/1998 | Nevin | 261/44.4 |
| 5,720,906 | 2/1998 | Yamanaka et al. | 261/35 |

FOREIGN PATENT DOCUMENTS

Y2-64 7235 2/1989 Japan .

*Primary Examiner*—Richard L. Chiesa
*Attorney, Agent, or Firm*—Birch, Stewart, Kolasch & Birch, LLP

[57] ABSTRACT

A variable venturi carburetor, which is part of an intake system of an internal combustion engine, includes structural features which allow an air intake path of the carburetor to be shortened, and which allow the size of air chambers of the carburetor to be reduced. A piston valve is composed of a plate-shaped valve and a tubular portion. The plate-shaped valve is guided by a pair of grooves provide in sidewalls of the intake path. The tubular portion is attached to one side of the plate-shaped valve near a center of the side of the plate-shaped valve. The tubular portion has a rectangular or square cross-section. Each side of the rectangular cross section is shorter than the internal diameter of the intake path. A flange is attached to an upper end of the piston valve. The flange is of a reduced diameter and facilitates connection of the piston valve to a diaphragm. Since the diameter of the flange is also less than the diameter of the intake path, a vacuum chamber and an atmosphere chamber of the carburetor can be reduced in size.

20 Claims, 5 Drawing Sheets

VARIABLE VENTURI CARBURETOR

BACKGROUND OF THE INVENTION

1. Field of the Invention

The present invention relates to an improved variable venturi carburetor, which is part of an intake system of an internal combustion engine. More particularly, the present invention relates to structural features of the carburetor, which allow an air intake path of the carburetor to be shortened, and which allow the size of upper air chambers of the carburetor to be reduced.

2. Description of the Background Art

Variable venturi carburetors are known. For example, Japanese Utility Model Application No. SHO 64-7235 discloses a variable venturi carburetor.

In the variable venturi carburetor of the background art, a piston valve of the carburetor is formed as a hollow cylindrical body. A diameter of the piston valve is larger than an internal diameter of the venturi. Therefore, the piston valve occupies a large portion of the intake path of the carburetor. As a result, the intake path must be made relatively long. Further, a flange at the upper end of the piston valve, which is used to connect a diaphragm to the piston valve, must have a relatively large diameter. Accordingly, the diaphragm coupled the flange is large in diameter. The large diaphragm requires that large upper air chambers be formed on the carburetor.

SUMMARY AND OBJECTS OF THE INVENTION

The present invention has as an object to provide a compact variable venturi carburetor. The carburetor has an intake path, which is shorter than the intake path of the carburetors of the background art. Further, the diaphragm and upper air chambers are smaller than the corresponding structures of the carburetors of background art.

These and other objects of the present invention are fulfilled by providing a carburetor comprising: a body; an intake path of a first diameter formed in said body; a diaphragm chamber formed in said body; a guide hole communicating between said intake path and said diaphragm chamber; a piston valve reciprocally mounted in said guide hole, said piston valve partially blocking said intake path to form a venturi between a first end of said piston valve and a venturi side wall of said intake path; and a diaphragm connecting a periphery of a second end of said piston valve to a periphery of enclosure walls defining said diaphragm chamber, said diaphragm separating said diaphragm chamber into a vacuum chamber and an atmospheric chamber; wherein said piston valve includes a plate, having a dimension as large as said first diameter; and a tubular portion attached to said plate, said tubular portion having a first hole formed in a first end thereof facing said venturi, a second hole in a second end thereof opening to said vacuum chamber, and an air path connecting said first hole and said second hole.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENT

A preferred embodiment of the present invention will be explained with reference to the accompanying drawings.

Figure 1:
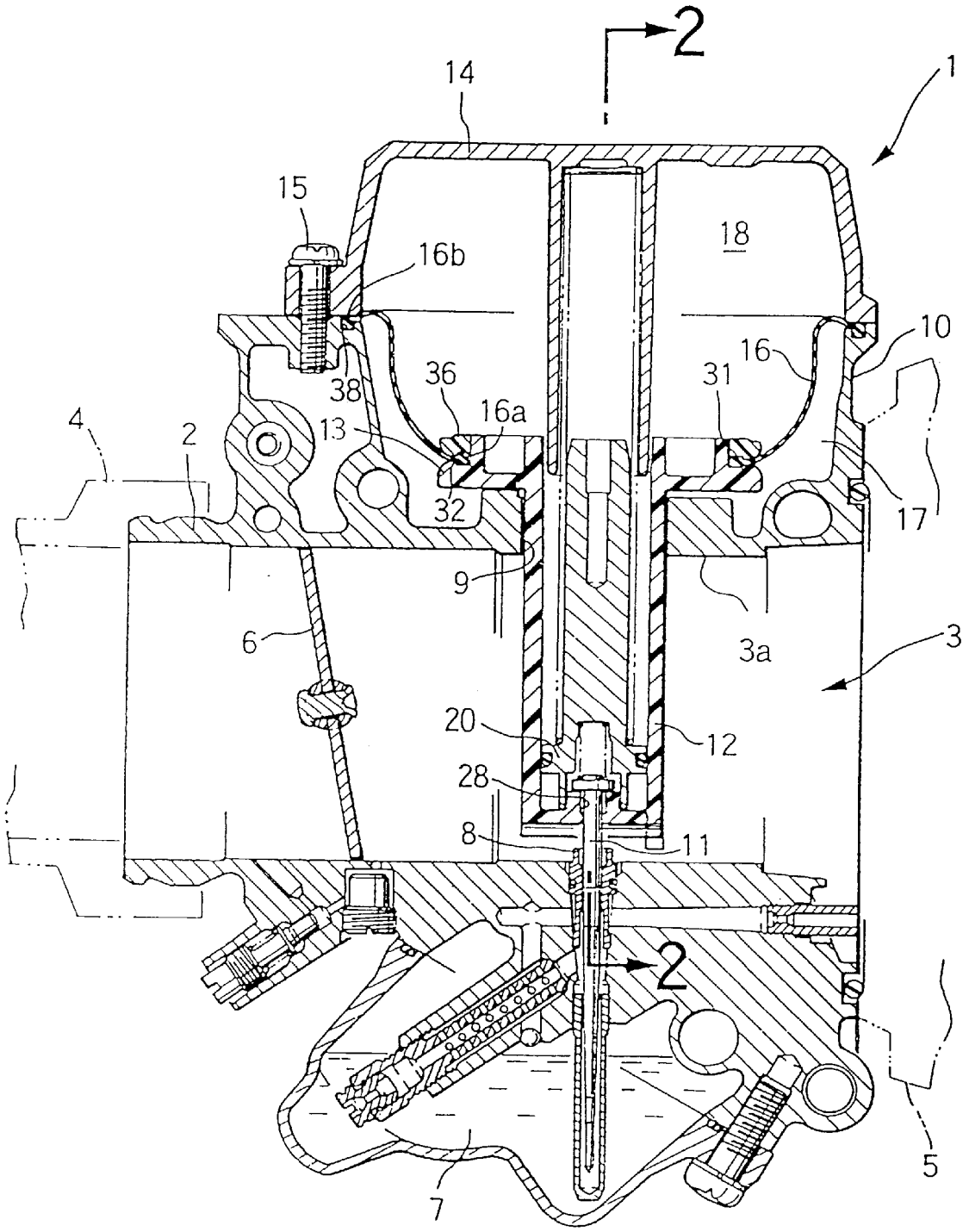
FIG. 1 is a cross sectional side view of a variable venturi carburetor according to the present invention.
Figure 2:
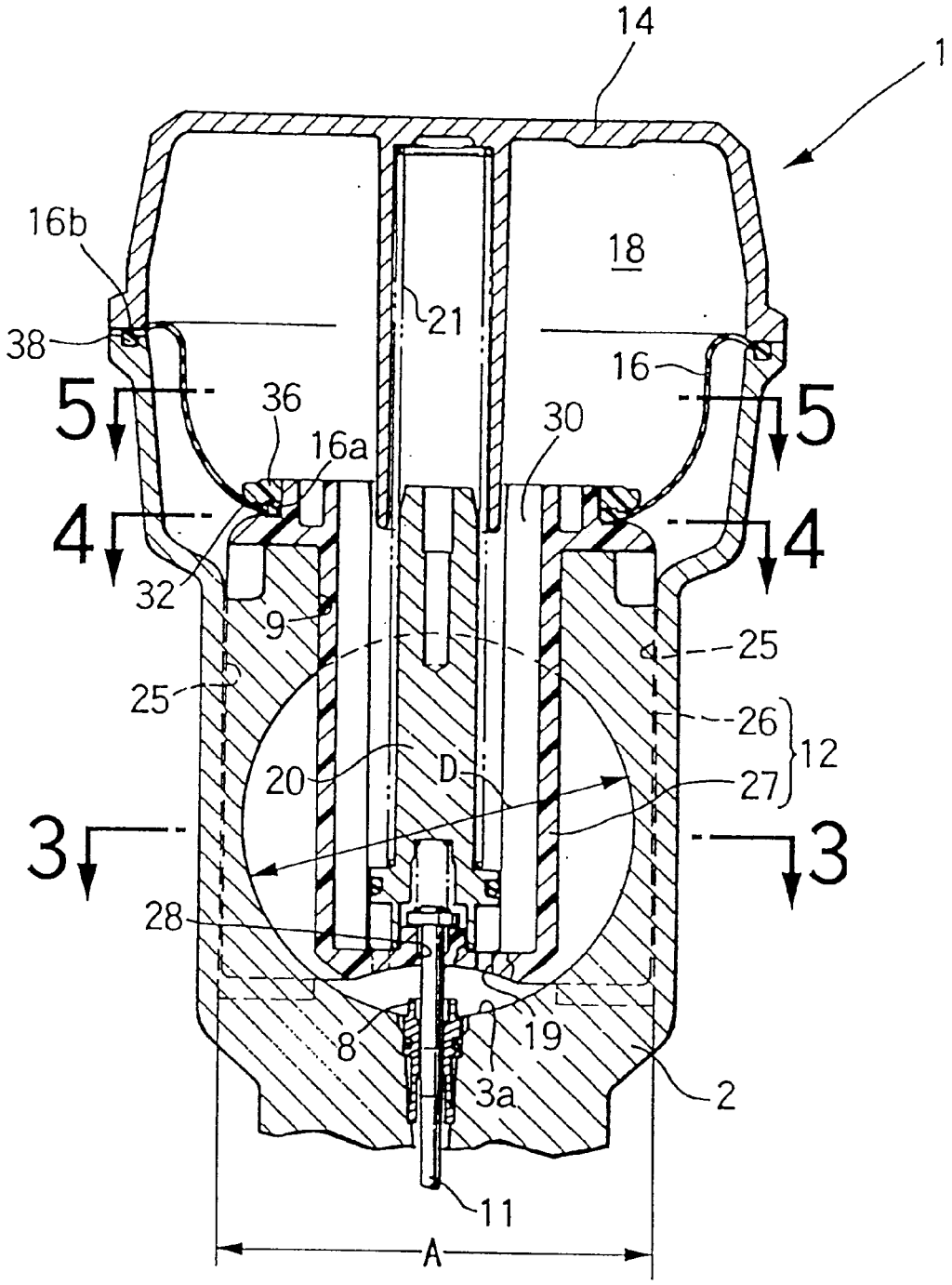
FIG. 2 is a cross sectional view along the line 2—2 of FIG. 1.

FIGS. 1 and 2 illustrate a variable venturi carburetor 1 of an internal combustion engine, such as a motorcycle's engine. The carburetor 1 includes; a carburetor body 2. An intake path 3, defined by a venturi 3*a*, extends through the carburetor body 2. An intake duct 4 of an intake port of the engine is connected to a left end of the intake path 3. A right end of the intake path 3 is connected to an air cleaner. Therefore, the right end of the intake path 3 is considered an upstream side of the intake path 3. The intake path 3 is provided with a butterfly type throttle valve 6 near the downstream side of the intake path 3.

A lower part of the carburetor body 2 includes a constant level, fuel chamber 7. Fuel is supplied from a fuel tank (not illustrated) to the fuel chamber 7. A main nozzle 8 connects the fuel chamber 7 to a bottom surface of the venturi 3*a*, so that fuel in the fuel chamber 7 can be supplied to the venturi 3*a*.

The carburetor body 2 is provided with a guide hole 9. The guide hole 9 opens into the venturi 3*a* through an upper wall of the venturi 3*a*. The guide hole 9 also opens into a diaphragm accommodating cylindrical portion 10. A piston valve 12 having a needle valve 11 is reciprocally mounted within the guide hole 9. The needle valve 11 is inserted into the main nozzle 8, so that the needle valve is reciprocally moveable relative to the main nozzle 8.

A flange 13 is connected to an upper end of the piston valve 12. The flange 13 contacts a lower surface of the cylindrical portion 10 to define a lower limit to the reciprocal movement of the piston valve 12. The lower limit is defined as the minimum opening angle of piston valve 12.

A cap 14 covers an upper end of the cylindrical portion 10. The cap 14 is joined to the cylindrical portion 10 with a bolt 15. A diaphragm 16 is provided between the flange 13 of the piston valve 12 and the intersection of the cylindrical portion 10 and cap 14. The diaphragm 16 divides an area defined inside the cylindrical portion 10 and the cap 14 into an atmospheric chamber 17, located below the diaphragm 16, and a vacuum chamber 18, located above the diaphragm 16. The atmospheric chamber 17 is communicated to the atmosphere either directly or through an air cleaner. The vacuum chamber 18 is communicated with the venturi 3*a* via a pair of negative pressure introducing holes 19, which will be explained later.

The piston valve 12 is provided with a retainer 20. The retainer 20 presses and holds the needle valve 11. A return spring 21 is fixed between the retainer 20 and the cap 14. The return spring 21 serves to bias the piston valve 12 downwardly.

In operation, air passes through the intake path 3. The amount of air passing through the intake path 3 is increased in response to an increase of an opening angle of the throttle valve 6. The passing air creates a negative pressure in the pair of negative pressure introducing holes 19. The speed of the passing air is directly related to the magnitude of the negative pressure generated. The negative pressure is communicated to the vacuum chamber 18. As the negative pressure builds in the vacuum chamber 18, the diaphragm 16 is moved upward.

The upward movement of the diaphragm 16 causes the piston valve 12 to move upward. The piston valve 12 rises up to the point where a balance occurs between the upward force applied by the diaphragm and the downward force applied by the returning spring 21. As the piston valve 12 moves upward, the opening angle of the venturi 3*a* is increased. By this arrangement, the venturi negative pressure is always adjusted. As the piston valve 12 moves upward in response to a high volume of airflow, the needle valve 11 moves upward relative to the main nozzle 8. As a result, more fuel is injected from the main nozzle 8 into the venturi 3*a*, thereby insuring an adequate air-fuel ratio.

As shown in FIG. 2 to FIG. 5, the piston valve 12 includes a plate type, valve portion 26, which is made of a synthetic resin material. The valve portion 26 is slideably engaged with vertically oriented guide grooves 25 formed in right and left internal walls of the venturi 3*a*. A negative pressure inducing tubular portion 27 is coupled to the valve portion 26. The tubular portion 27 is fixed to one side of the valve portion 26 near a central region of the valve portion 26. Upper end portions of the valve portion 26 and upper end portions of the tubular portion 27 are connected with the flange 13. The tubular portion 27 has a cross sectional shape of a square or rectangle. Each side of the rectangular cross sectional shape is shorter in length than an internal diameter D of the venturi 3*a*. The tubular portion 27 is hollow. A lower end of the tubular portion 27 is closed, save for a needle hole 28 though which the needle valve 11 passes and the pair of negative pressure introducing holes 19. The needle hole 28 is provided between the pair of negative pressure introducing holes 19.

Internal walls of the tubular portion 27 are lined with a plurality of ribs 29. The ribs 29 extend in the vertical direction. End portions of these ribs 29 support the retainer 20. Around the retainer 20, a path 30 is defined between the adjacent ribs 29. The path 30 communicates the pair of negative pressure introducing holes 19 to the vacuum chamber 18.

The flange 13 includes a disk portion 13*a*, continuously coupled with an upper side edge of the valve portion 26, and a crescent-shaped extending portion 13*b*. The disk portion 13*a* has a diameter d that is smaller than a lateral width A of the valve portion 26. The crescent-shaped extending portion 13*b* extends from an external circumference of the disk portion 13*a*. A circular coupling cylinder 31 is integrally formed to an upper surface of the disk portion 13*a*. The circular coupling cylinder 31 is located above and surrounds an upper end of the tubular portion 27. An annular engaging groove 32 is formed in the disk portion 13*a* adjacent to, and surrounding, the coupling cylinder 31.

Figure 5:
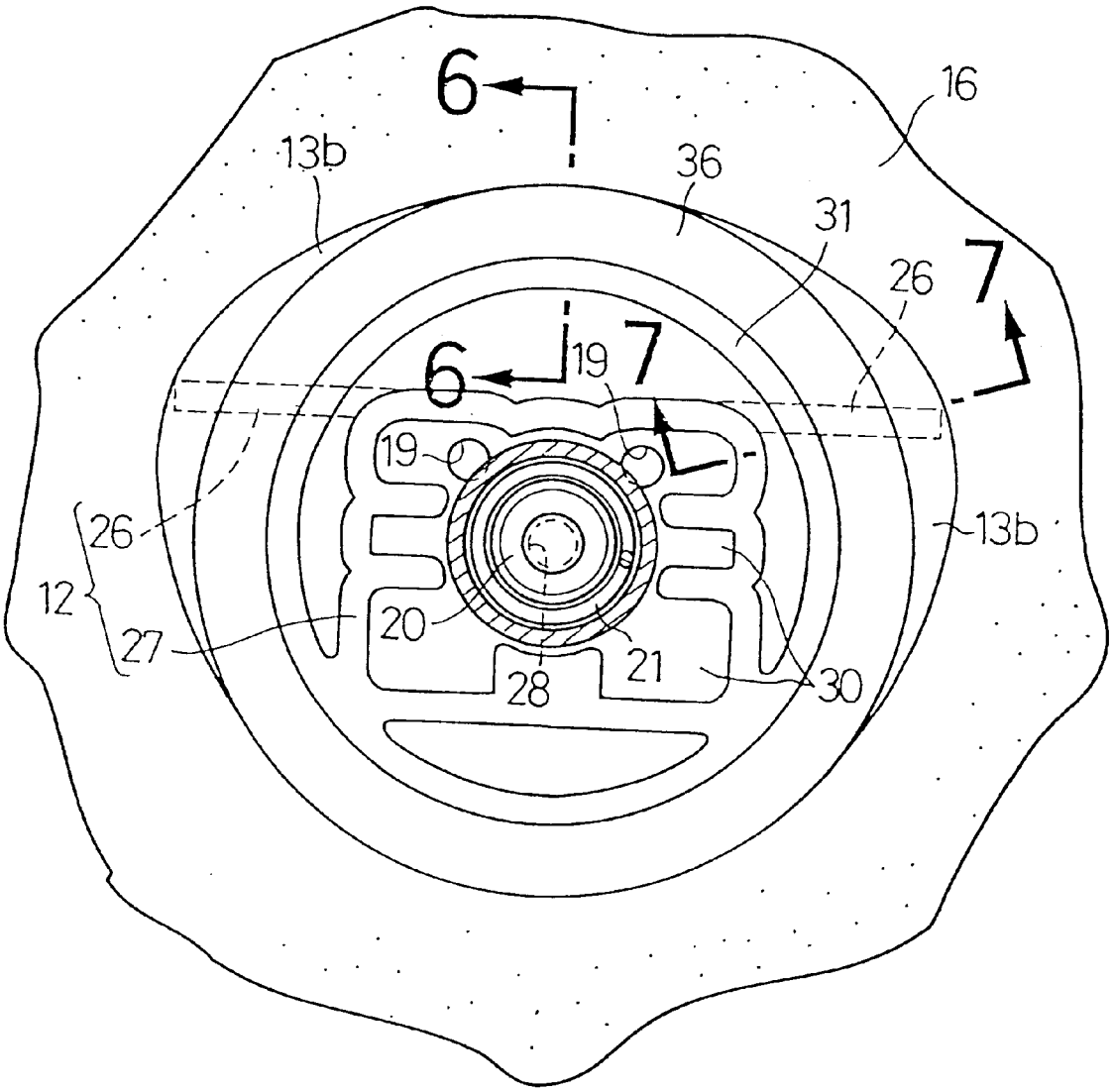
FIG. 5 is a cross sectional view along the line 5—5 of FIG. 2.
Figure 6:
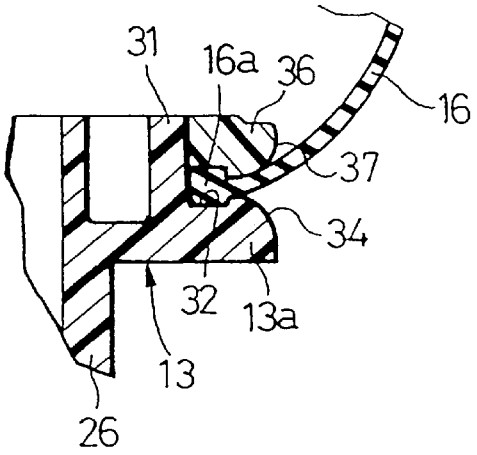
FIG. 6 is a cross sectional view along the line 6—6 of FIG. 5.
Figure 7:
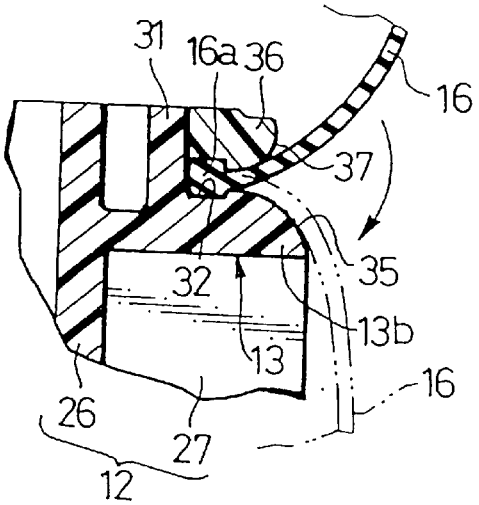
FIG. 7 is a cross sectional view along the line 7—7 of FIG. 5.

As shown in FIGS. 5 to 7, the upper surface of the disk portion 13*a* of the flange 13 is provided with the fillet 34 along its circumferential edge. The upper surface of the extending portion 13*b* is provided with a fillet 35 along its circumferential edge. The fillet 34 has a smaller radius of curvature than the fillet 35.

The diaphragm 16 includes an internal circumference bead 16*a*. To attach the diaphragm 16 to the flange 13, the internal circumference bead 16*a* is engaged within the engaging groove 32 of the disc portion 13*a*. An annular, holding ring 36, made of the synthetic resin material, is provided. The holding ring 36 has a diameter substantially the same as the disk portion 13*a*. Further, the holding ring 36 is provided with a fillet 37 on a lower surface near the circumferential edge of the holding ring 36. The holding ring 36 is engaged and welded to an external circumference of the coupling cylinder 31. The holding ring 36 sandwiches the internal circumference bead 16*a* into the engaging groove 32.

The cylindrical portion 10 includes an annular engaging groove 38 formed in an upper rim. The diaphragm 16 includes an external circumference bead 16*b*. To attach the diaphragm 16 to the cylindrical portion 10, the external circumference bead 16*b* is engaged within the annular engaging groove 38. Joining the cap 14 to cylindrical portion 10 with the bolt 15 causes the cap 14 to sandwich the external circumference bead 16*b* into the annular engaging groove 38.

The structure of the carburetor of the present invention results in various advantages over carburetors constructed in accordance with the background art. First, the structure of the piston valve 12 allows the length of the intake path 3 to be shortened. The piston valve 12 includes the plate-type valve portion 26 and the tubular portion 27. The tubular portion 27 has each side wall thereof shorter than the internal diameter D of the venturi 3*a*. By this arrangement, a thickness of the piston valve 12 along the direction of the intake path 3 is smaller than the internal diameter D of the venturi 3*a*. Therefore, the space that the piston valve 12 occupies in the direction of the intake path is less than the space occupied by a conventional circular piston valve. Thereby, the length of the intake path 3 can be made shorter than the intake path of a conventional carburetor.

Second, the flange 13 at the upper end of the piston valve 12 includes the disk portion 13*a* and the crescent-shaped extending portion 13*b*. The disk portion 13*a* has the diameter d that is smaller than the lateral width A of the valve portion 26. Only an extent of the crescent-shaped extending portion 13*b* needs to be as wide of the lateral width A of the valve portion 26. By this arrangement, the diaphragm 16 can have a smaller inner diameter than the lateral width A of the valve portion 26. Diaphragms of conventional carburetors required a diagram having a larger internal diameter. A smaller diaphragm 16 translates into a smaller housing for the diaphragm 16. Therefore, the cylindrical portion 10 and cap 14 may be reduced in size.

Because the extending portion 13*b* is connected to the upper side edges of the valve portion 26, damage of diaphragm 16 due to the side edges of the valve portion 26 contacting the diaphragm can be prevented. Moreover, the diaphragm 16 will not be damaged by contacting the upper surface of the extending portion 13*b*, since the upper surface of the extending portion 13*b* is provided with the fillet 35, having the radius of curvature which is larger than the radius of curvature of the fillet 34 of the disk portion 13*a*. Therefore, when the piston valve 12 moves upward or downward, interference between the extending portion 13*b* and diaphragm 16 can be avoided and damage of the diaphragm 16 can be prevented.

The holding ring 36 can be formed in a circular shape of the same diameter as the disk portion 13*a*. The holding ring 36 need not have a shape mirroring the extending portions 13*b*. Therefore, the holding ring 36 can be of a reduced size, further enabling the diaphragm 16, cylindrical portion 10 and cap 14 to be reduced in size. Since the holding ring 36 does not include portions corresponding to the extending portion 13*b*, it is not necessary during assembly to ensure that a phase of the holding ring 36 corresponds to the extending portions 13*b* of the flange 13, prior to fixing the holding ring 36 to the coupling cylinder 31.

Figure 3:
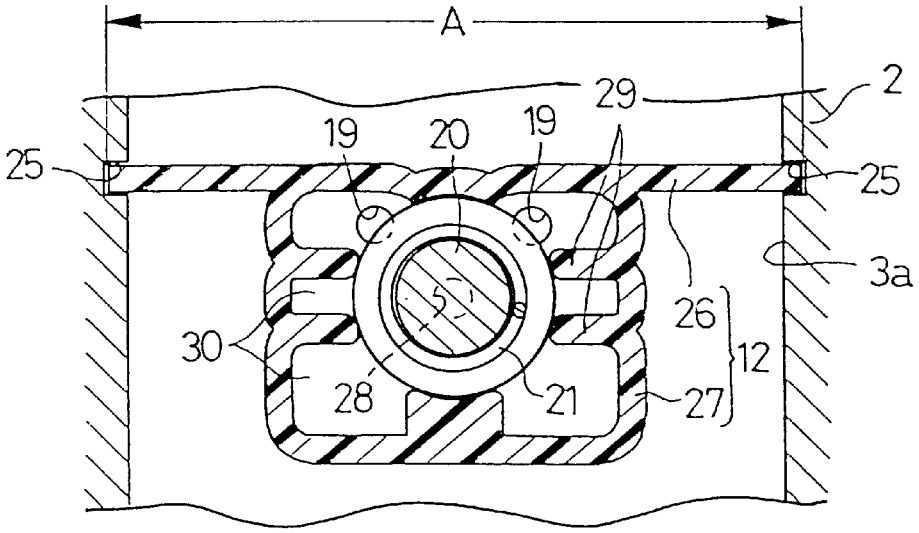
FIG. 3 is a cross sectional view along the line 3—3 of FIG. 2.
Figure 4:
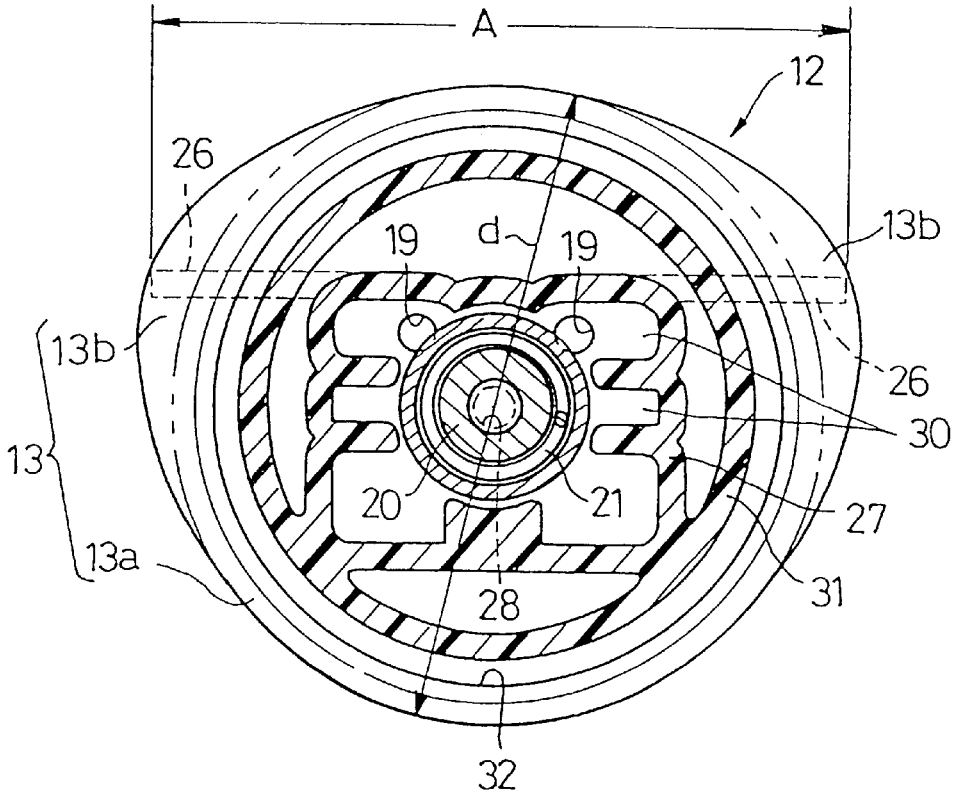
FIG. 4 is a cross sectional view along the line 4—4 of FIG. 2.

The invention being thus described, it will be obvious that the same may be varied in many ways. For example, the tubular portion 27 may have other cross sectional shapes than a square or rectangle. For instance a triangular or semi-circular cross sectional shape would also be suitable. Further, FIGS. 3–5 depict the tubular portion 27 as being attached to an upstream side of the valve portion 26. It is foreseeable that the tubular portion 27 may be attached to the downstream side of the valve portion 26, or that the tubular portion may project from both of the upstream and downstream sides of the valve portion 26. Such variations are not to be regarded as a departure from the spirit and scope of the invention, and all such modifications as would be obvious to one skilled in the art are intended to be included within the scope of the following claims.

We claim:

1. A carburetor comprising:

a body;

an intake path of a first diameter formed in said body;

a diaphragm chamber formed in said body;

a guide hole communicating between said intake path and said diaphragm chamber;

a piston valve reciprocally mounted in said guide hole, said piston valve partially blocking said intake path to form a venturi between a first end of said piston valve and a venturi side wall of said intake path; and a diaphragm connecting a periphery of a second end of said piston valve to a periphery of enclosure walls defining said diaphragm chamber, said diaphragm separating said diaphragm chamber into a vacuum chamber and an atmospheric chamber;

wherein said piston valve includes a plate, having a dimension as large as said first diameter; and a tubular portion attached to said plate, said tubular portion having a first hole formed in a first end thereof facing said venturi, a second hole in a second end thereof opening to said vacuum chamber, and an air path connecting said first hole and said second hole.

2. The carburetor according to claim 1, wherein said piston valve is reciprocally moveable along a first axis, and wherein all cross sectional dimensions of said tubular portion taken at right angles to said first axis are less than said first diameter.

3. The carburetor according to claim 1, further comprising:

first and second grooves formed in opposing side walls of said intake path, respectively, said plate being guided for reciprocal movement by said first and second grooves.

4. The carburetor according to claim 1, further comprising:

a fuel chamber formed in said body;

a nozzle formed in said venturi side wall, said nozzle extending into said fuel chamber;

a third hole formed in said first end of said tubular portion; and a needle extending from said third hole and into said nozzle.

5. The carburetor according to claim 1, wherein said tubular portion includes a plurality of internal vertically extending ribs, said air path being formed between said vertically extending ribs.

6. The carburetor according to claim 5, further comprising:

a retainer disposed inside said tubular portion, adjacent said vertically extending ribs; and a spring biasing said retainer toward said first end of said tubular portion.

7. The carburetor according to claim 1, wherein said tubular portion resides on one side of said plate.

8. The carburetor according to claim 7, wherein said one side of said plate faces toward a direction of airflow through said intake path.

9. The carburetor according to claim 7, wherein said tubular portion is centrally located on said one side of said plate.

10. The carburetor according to claim 9, wherein said one side of said plate faces toward a direction of airflow through said intake path.

11. The carburetor according to claim 1, further comprising:

a flange formed adjacent said second end of said tubular portion, said flange extending away from said tubular portion;

a coupling cylinder formed on said flange, said coupling cylinder surrounding said second end of said tubular portion, and said coupling cylinder extending in substantially a same direction as said tubular portion;

wherein an inner opening of said diaphragm rests on an upper surface of said flange and abuts against said coupling cylinder.

12. The carburetor according to claim 11, further comprising:

a holding ring, said holding ring having an inner diameter which corresponds to an inner diameter of said inner opening of said diaphragm, said holding ring resting upon said diaphragm and abutting against said coupling cylinder, sandwiching said diaphragm between said upper surface of said flange and a lower surface of said holding ring.

13. The carburetor according to claim 12, wherein said inner diameter of said inner opening of said diaphragm is less than said first diameter of said intake path.

14. The carburetor according to claim 12, further comprising:

an annular groove formed in said upper surface of said flange; and an annular bead formed around said inner opening of said diaphragm;

wherein said annular bead resides in said annular groove when said diaphragm is sandwiched between said upper surface of said flange and said lower surface of said holding ring.

15. The carburetor according to claim 12, wherein said flange includes two extended portions, each extended portion covering an upper edge of said plate.

16. The carburetor according to claim 12, wherein said upper surface of said flange includes a first fillet around its outer periphery.

17. The carburetor according to claim 16, wherein said flange includes two extended portions, each extended portion covering an upper edge of said plate, each extended portion including a second fillet around its outer periphery.

18. The carburetor according to claim 17, wherein said second fillet has a radius of curvature which is greater than a radius of curvature of said first fillet.

19. The carburetor according to claim 16, wherein said lower surface of said holding ring includes a third fillet around its outer periphery.

20. The carburetor according to claim 19, wherein said third fillet has a radius of curvature which is substantially equal to a radius of curvature of said first fillet.

* * * * *